US007214882B2

(12) United States Patent
Brandi et al.

(10) Patent No.: US 7,214,882 B2
(45) Date of Patent: May 8, 2007

(54) COMMUNICATIONS CABLE, METHOD AND PLANT FOR MANUFACTURING THE SAME

(75) Inventors: Giovanni Brandi, Milan (IT); Luca Giorgio Maria De Rai, Milan (IT)

(73) Assignee: Prysmian Cavi E Sistemi Energia S.r.L., Milan (IT)

( * ) Notice: Subject to any disclaimer, the term of this patent is extended or adjusted under 35 U.S.C. 154(b) by 0 days.

(21) Appl. No.: 10/467,895

(22) PCT Filed: Feb. 26, 2002

(86) PCT No.: PCT/EP02/02003

§ 371 (c)(1),
(2), (4) Date: Jan. 29, 2004

(87) PCT Pub. No.: WO02/073634

PCT Pub. Date: Sep. 19, 2002

(65) Prior Publication Data

US 2004/0112628 A1 Jun. 17, 2004

Related U.S. Application Data

(60) Provisional application No. 60/272,758, filed on Mar. 5, 2001.

(30) Foreign Application Priority Data

Feb. 28, 2001 (EP) ..... 01200743

(51) Int. Cl.
*H01R 7/00* (2006.01)

(52) U.S. Cl. ..... 174/110 R; 174/113 R

(58) Field of Classification Search ..... 174/110 R, 174/113 R, 113 C, 113 A, 113 AS, 36, 27, 174/115, 116
See application file for complete search history.

(56) References Cited

U.S. PATENT DOCUMENTS

| | | | | |
|---|---|---|---|---|
| 1,940,917 | A * | 12/1933 | Naotaro | 174/113 C |
| 3,610,814 | A * | 10/1971 | Peacock | 174/113 R |
| 4,755,629 | A | 7/1988 | Beggs et al. | |
| 5,132,488 | A * | 7/1992 | Tessier et al. | 174/34 |
| 5,767,441 | A | 6/1998 | Brorein et al. | |
| 5,789,711 | A * | 8/1998 | Gaeris et al. | 174/113 C |
| 5,952,615 | A * | 9/1999 | Prudhon | 174/113 C |
| 5,969,295 | A * | 10/1999 | Boucino et al. | 174/113 C |
| 6,162,992 | A * | 12/2000 | Clark et al. | 174/113 R |

(Continued)

FOREIGN PATENT DOCUMENTS

EP 0 828 259 A2 3/1998

(Continued)

*Primary Examiner*—William H. Mayo, III
(74) *Attorney, Agent, or Firm*—Finnegan, Henderson, Farabow, Garrett & Dunner, L.L.P.

(57) ABSTRACT

A method, an extrusion apparatus and a plant for continuously manufacturing a communication cable. A plurality of twisted pairs of insulated conductors are housed in respective cavities longitudinally formed within an elongated integral body. The cavities have a substantially circular cross-section and maximum diameter adapted to prevent any relative movement of the twisted pairs of insulated conductors with respect to one another, while each of the pairs of insulated conductors is substantially free to move within the cavities along the longitudinal direction of the cable.

7 Claims, 8 Drawing Sheets

U.S. PATENT DOCUMENTS

| | | | | |
|---|---|---|---|---|
| 6,211,467 | B1 * | 4/2001 | Berelsman et al. | 174/113 R |
| 6,248,954 | B1 * | 6/2001 | Clark et al. | 174/113 R |
| 6,297,454 | B1 * | 10/2001 | Gareis | 174/113 C |
| 6,365,836 | B1 * | 4/2002 | Blouin et al. | 174/113 C |
| 6,566,607 | B1 * | 5/2003 | Walling | 174/113 R |
| 6,639,152 | B2 * | 10/2003 | Glew et al. | 174/113 C |
| 2004/0055781 | A1 * | 3/2004 | Cornibert et al. | 174/135 |

FOREIGN PATENT DOCUMENTS

| | | | |
|---|---|---|---|
| EP | 1 162 632 A | * | 6/2000 |
| JP | 04-332406 A | * | 11/1992 |
| WO | WO 98/11563 | | 3/1998 |

* cited by examiner

COMMUNICATIONS CABLE, METHOD AND PLANT FOR MANUFACTURING THE SAME

CROSS REFERENCE TO RELATED APPLICATIONS

This application is a national phase application based on PCT/EP02/02003, filed Feb. 26, 2002, the content of which is incorporated herein by reference, and claims priority of European Patent Application No. 01200743.1, filed Feb. 28, 2001, the content of which is incorporated herein by reference, and claims the benefit of U.S. Provisional Application No. 60/272,758, filed Mar. 5, 2001, the content of which is incorporated herein by reference.

TECHNICAL FIELD

The present invention generally relates to a communications cable and, more particularly, to a high frequency unshielded telecommunications cable comprising at least one couple of twisted pairs of insulated conductors. This invention also relates to a method for manufacturing a communications cable, as well as to an extrusion apparatus and to a plant comprising said extrusion apparatus for carrying out said method.

BACKGROUND ART

Many communications systems utilize cables having a plurality of twisted pairs of insulated conductors.

A communications cable utilizing twisted pair technology must meet stringent requirements with regard to data speed and electrical characteristics, such as a reduced cross-talk and a good electrical stability. When twisted pairs are closely bundled such as in a communications cable, disturbance of the signal transmitted by a twisted pair may occur due to electromagnetic interference between two different twisted pairs. Such phenomenon of signal disturbance, usually referred to as "cross-talk", is highly undesirable and should be at least minimized if not eliminated altogether.

So, in the art of communications cables, the term NEXT (Near End Cross-Talk) indicates a transfer of energy from one pair to another measured between near ends (i.e. the disturbance caused on a receiving pair by a transmitting pair at the same end), the term FEXT (Far End Cross-Talk) indicates a transfer of energy from one pair to another measured between far ends (i.e. the disturbance caused to a receiving pair by a transmitting pair at the opposite end of the cable), while the term "power-sum cross-talk" indicates the overall transfer of energy towards one pair from all the other pairs.

Cross-talk especially presents a problem in high frequency applications because cross-talk increases logarithmically as the frequency of the transmission increases. At high frequency, furthermore, NEXT is the most relevant cross-talk phenomenon.

In an attempt to reduce the cross-talk phenomenon it was suggested in the art, as reported in U.S. Pat. No. 5,789,711, to use very complex lay techniques of the twisted pairs. In conventional cables, each twisted pair of a cable has a specified distance between twists along the longitudinal direction, that distance being referred to as lay length. When adjacent twisted pairs have the same lay length and/or twist direction, they tend to lie within a cable more closely spaced than when they have different lay lengths and/or twist direction. Twist direction may also be varied.

The use of such lay techniques to control the cross-talk phenomenon, however, has several disadvantages such as complexity, cost and susceptibility of the twisted conductors to electrical instability during use.

As an alternative remedy to reduce the cross-talk phenomenon, it was also proposed in the art, as reported in U.S. Pat. No. 5,789,711, to use shielded pairs of twisted conductors.

However, although being less prone to the cross-talk phenomenon, shielded cables are difficult and time consuming to install and terminate. Shielded conductors, in fact, are generally terminated using special tools, devices and techniques adapted for the job.

Shielding of twisted pairs is costly and complex to process and also susceptible to geometric instability during processing and use.

In order to reduce the cross-talk phenomenon, it was also proposed to use spacing means to space apart the twisted pairs of insulated conductors such as disclosed in U.S. Pat. No. 5,969,295. This reference describes a cable obtained by extruding a jacket around twisted pairs of insulated conductors reciprocally spaced by a cross-shaped spacer. In one embodiment, the jacket becomes integrally bonded to the radially outer tips of the spacer walls, thus defining a plurality of sector-shaped cavities each housing a respective pair of insulated conductors.

The cable disclosed by U.S. Pat. No. 5,969,295, however, is difficult to manufacture, possesses inhomogeneous mechanical properties and the construction thereof does not allow to prevent possible relative movements, albeit small, between pairs housed in adjacent sector-shaped cavities. In particular, on the one hand, the presence of the spacer may increase the stiffness of the cable, thus preventing an easy bending of the same, which bending is instead desirable for an easy installation of the cable. On the other hand, relatively low radial strains may instead damage the wall portions of the cross-shaped spacer, with an ensuing collapse of the cavities which could trigger the very cross-talk phenomenon which should be avoided.

Additionally, in order to hold the cable components together, the cross-shaped spacer and the cavities thereby formed in the cable of U.S. Pat. No. 5,969,295 are subjected to a helical torsion along the cable length, which requires an additional manufacturing step.

In another attempt to reduce the cross-talk phenomenon, EP-A-0 828 259 teaches to embed twisted pairs of insulated conductors within a flexible plastic material so as to stabilize the reciprocal position of the pairs.

However, a cable of this kind while showing, on the one hand, a satisfactory control of the cross-talk phenomenon coupled to a good mechanical resistance, is affected, on the other hand, by electrical and handling problems. A first problem which may occur is the difficulty of stripping the flexible material from the twisted pairs of insulated conductors without causing damage to the structure of the cable. A second problem is related to the possible permanent deformations which may occur whenever the bending radius of the cable is lower than a certain value. Such deformations may cause a variation in the impedance of the conductors, with consequent attenuation of the transmitted signal. Said variation of impedance is related to the "return loss" parameter, i.e. the ratio between the amount of power supplied to a conductor and the amount of power which is reflected along said conductor: the higher the parameter, the lower the attenuation. A third problem is related to the rigidity of this kind of cable which may render troublesome the handling and the installation of the same.

SUMMARY OF THE INVENTION

The Applicant has now found a new communications cable having desired electrical characteristics and good transmission parameters, such as controlled or reduced cross-talk, good electrical stability, and impedance, and mechanical characteristics which enable the cable to be easily manufactured, handled and installed.

According to a first aspect of the invention, the present invention relates to a communications cable comprising at least two twisted pairs of insulated conductors housed in respective independent cavities longitudinally formed within an elongated integral body, said cavities having a substantially circular cross-section and a maximum diameter adapted to prevent any relative movement of the twisted pairs of insulated conductors with respect to one another. In particular, said pairs of insulated conductors are slidingly housed in said cavities in such a way that each of said pairs of insulated conductors is substantially free to move within said cavities along the longitudinal direction of the cable.

In the present description and claims, the term "independent", referred to the cavities formed within the elongated body, means that each of said cavities is defined by a continuous peripheral wall, which physically separates said cavity from each of the other cavities.

In addition, due to the predetermined form and dimension of the longitudinal cavities housing the twisted pairs, any movement of the twisted pairs in a direction different from the longitudinal one is substantially prevented.

In the following description and in the subsequent claims, the term "substantially circular cross-section" is used to indicate not only a perfectly circular cross-section, but also any cross-section which is comparable to a circular cross-section for its intended purpose, e.g. slightly oval.

In the following description and in the subsequent claims, the expression "maximum diameter" is intended to indicate either the diameter of the cavity when the cross-section of the cavity is circular, or the maximum cross-sectional dimension of the cavity when the cross-section of the cavity is not perfectly circular.

Advantageously, the communications cable of the present invention enables to achieve an optimal control of the cross-talk phenomenon thanks to the fact that the twisted pairs are housed in the cavities in a substantially fixed position with respect to one another, i.e. thanks to the fact that any movement of the twisted pairs along the radial and circumferential direction of the cable is substantially prevented.

At the same time, however, each pair is free to slide within the cavities along the longitudinal direction of the cable, so that the twisted pairs can move with respect to one another along the longitudinal direction when the cable is bent and can also be easily extracted from the cavities during the installation of the cable without risks of damaging the insulated conductors. Advantageously, the cable construction of the invention does not require, as it is common in the prior art, any helical torsion of the cavities along the cable length to help the stabilization of the twisted pairs of insulated conductors, with an outstanding simplification of the manufacturing operation and with a reduction of costs.

The cable of the invention also has a good mechanical strength, while maintaining an adequate flexibility which facilitates the handling and the installation of the cable, thanks to the presence of a one-piece body for containing and separating the twisted pairs.

The elongated integral body is preferably made of a polymeric material suitable for manufacturing a cable, such as materials including polyolefins, for example polyethylene (PE), polypropylene (PP), polyvinylchloride (PVC), polyvinylchloride alloys, ethylene vinylacetate copolymers (EVA), fluorinated copolymers such as fluorinated ethylene-propylene copolymers (FEP) and ethylene trifluoroethylene copolymers (ETFE), polyurethane and low smoke zero halogen (LSOH) compositions, such as PE, PP or EVA incorporating flame retardant additives, such as inorganic fillers, including magnesium hydroxide and calcium carbonate.

Preferably, said insulated conductors are twisted in pairs at different lay lengths, the lay length being preferably comprised between about 10 mm and about 30 mm and, still more preferably, the lay length of each pair differing from the lay length of another pair of about 0.5 mm to about 5 mm.

These different lay lengths contribute to reduce the cross-talk phenomenon. Preferably, the cavities have a maximum diameter comprised between about 1.5 mm and about 3.0 mm, depending on the diameter of the conductors forming the twisted pair.

In this way, it was observed that an optimal effect of preventing any radial or circumferential movement of the twisted pairs of insulated conductors was achieved by the cable.

Preferably, the elongated body comprises two cavities—respectively housing a first and a second twisted pair—angularly offset at an angle of about 180° with respect to one another.

According to a preferred embodiment of the invention, three or four cavities are formed within the elongated integral body, said three or four cavities being angularly offset at an angle of about 120° or of about 90°, respectively. In this way, the maximum reciprocal distance among the twisted pairs is advantageously achieved.

In an alternative embodiment, said communications cable may further comprise at least one cavity longitudinally formed within said elongated integral body for slidingly housing a respective optical transmitting element. In contrast with the dimensional requirement according to which the cavities housing the twisted pairs must have a suitable value of maximum diameter adapted to prevent any relative movement of the twisted pairs with respect to one another, a cavity housing an optical transmitting element may have a cross-section of any suitable shape, provided that the latter is sufficient for the cavity to contain the transmitting element itself.

Preferably, such a cavity has a substantially circular cross-section. In the present description and in the subsequent claims, the term "optical transmitting element" refers to any transmitting element comprising an optical fiber, including a single optical fiber, a plurality of optical fibers, a bundle of optical fibers or a ribbon of optical fibers, which may be housed within said cavity either as such or enclosed in a protective structure. In this latter case, the protective structure may comprise a polymeric sheath; optionally, it may further comprise additional polymeric sheaths and/or reinforcing elements, such as tensile resistant yarns (e.g. Kevlar®).

In a further alternative embodiment, said communications cable may comprise at least one additional cavity longitudinally formed within said elongated integral body and adapted to house an electrically conductive element.

In the present description and in the subsequent claims, the term "electrically conductive element" refers to any elongated element, typically of metal, e.g. copper or aluminum, capable of transmitting electrical energy, including bare or insulated metal wire and insulated twisted metal wires, wherein the term wires comprises either plenum metal conductor or a plurality of stranded metal conductors.

A cavity housing an electrically conductive element may have a cross-section of any suitable shape, provided that the latter is sufficient for the cavity to contain the electrically conductive element itself.

Preferably, such a cavity has a substantially circular cross-section. In a further alternative embodiment, the communications cable of the invention comprises four cavities angularly offset at an angle of about 90° the cavities housing: at least two twisted pairs of insulated conductors, an optical transmitting element and an electrically conductive element.

Preferably, the twisted pairs are conveniently housed in those cavities which are angularly offset at an angle of about 180° achieving in this way the maximum reciprocal distance among the same.

In a preferred embodiment, the cable may comprise a longitudinal reinforcing member disposed within said elongated integral body. More preferably, said longitudinal reinforcing member is centrally disposed within said elongated body.

The presence of the reinforcing member advantageously confers to the cable an additional strength, which is desirable when cables are required to be installed with high pulling strength or when the cable includes optical elements.

According to a further aspect thereof, the invention relates to an extrusion apparatus for continuously manufacturing a communications cable, comprising:

a) an extrusion die provided with an extrusion axis and including:

i) a female die having a first substantially funnel-shaped portion and a second substantially cylindrical portion having a substantially constant diameter, and ii) a male die comprising a support body supporting a plurality of ducts along a direction parallel to said extrusion axis and according to a predetermined spatial configuration and a ring-shaped splitting member supported by said ducts at a predetermined distance from said female die;

wherein an extrusion flowpath is defined within the male die between the ring-shaped splitting member and said support body and between the male die and the female die, and wherein the free ends of said ducts are housed in said second portion of the female die.

Advantageously, the extrusion apparatus of the invention comprises a plurality of ducts substantially arranged according to the same spatial configuration which the twisted pairs of insulated conductors have in the final cable. Thus, for example, four ducts arranged according to a square array may be provided in a male die of an extrusion apparatus designed for manufacturing a final cable comprising four longitudinal cavities angularly offset at an angle of about 90°, while three ducts arranged according to a triangular array may be provided in a male die of an extrusion apparatus designed for manufacturing a final cable comprising three longitudinal cavities angularly offset at an angle of about 120°.

More specifically, in the extrusion apparatus of the invention, a radially inner portion of the extrusion flowpath is defined within the male die between the ring-shaped splitting member and the support body, and a radially outer portion of the extrusion flowpath is defined between the male die and the female die.

In other words, the ring-shaped splitting member splits the overall flow of a suitable polymeric material being extruded into radially inner and radially outer subflows which will form the radially inner and, respectively, the radially outer portions of the elongated integral body of the cable.

More specifically, the radially inner subflow of the polymeric material will form a central core portion and a number of spacer portions radially extending therefrom of the elongated integral body, while the radially outer subflow of the polymeric material will form an outer jacket portion integral with said spacer and core portions.

Preferably, the distance between the front side of the ring-shaped splitting member and an inner opening of the second portion of the female die is comprised between about 1 mm and about 4 mm.

In the present description and in the following claims, the terms "front" and "rear" are used to indicate, respectively, those parts of the extrusion apparatus which are closest and, respectively, farthest from the outer opening of the female die.

By suitably selecting the distance between the front side of the ring-shaped splitting member and the inner opening of the second portion of the female die, it is advantageously possible to determine the thickness of all the portions (core, spacers and outer jacket) of the elongated integral body in order to meet the final geometrical requirements of the cable.

According to a preferred feature of the invention, the free ends of the ducts are housed in said second portion of the female die at a predetermined distance from an outer opening of said second portion. Preferably, said distance is comprised between about 1 mm and about 3 mm.

In this way, the extrusion flowpath defined within the extrusion apparatus of the invention advantageously comprises, upstream of the outer opening of the female die, an end portion having a predetermined length which allows to stabilize the shape of the elongated integral body and, most importantly, the shape of the cavities defined therein.

Preferably, the distance between the front side of the ring-shaped splitting member and the free end of the ducts is comprised between about 6 mm and about 10 mm.

Preferably, the inner walls of said first portion of the female die form an angle with respect to the extrusion axis comprised between about 25° and about 30°.

Such inclination of the inner walls of the first portion of the female die with respect to the extrusion axis advantageously enables to optimize the flow of the extruding material.

In a preferred embodiment, the radially outer surface of the ring-shaped splitting member is tapered.

Preferably, the radially outer surface of the ring-shaped splitting member form a taper angle with respect to the extrusion axis comprised between about 25°and about 30°.

More preferably, the taper angle formed between the outer surface of the ring-shaped splitting member and the extrusion axis is equal to the angle formed between the inner walls of the first portion of the female die and the extrusion axis.

In this embodiment, in which the outer surface of the ring-shaped splitting member and the inner walls of the first portion of the female die are substantially parallel to one another, the flow of the polymeric material within the extruder may advantageously be optimized.

Advantageously, furthermore, the above-mentioned ranges of the taper angle allow to determine the cross-section of the radially outer portion of the extrusion flowpath in such a way as to obtain an adequate extrusion rate of the material being extruded, while avoiding the risks of creating an undesired turbulence of the flowing material and/or dead points within the extrusion flowpath.

Preferably, the distance between the radially outer surface of the ring-shaped splitting member and the inner walls of the first portion of the female die is substantially constant and is comprised between about 1 mm and about 3 mm.

By supporting the radially outer surface of the ring-shaped splitting member at the aforementioned range of distances from the inner walls of the first portion of the female die, it is advantageously possible to regulate to optimal values the flow rate of the material being extruded which flows in the outer portion of the extrusion flowpath, thereby regulating the thickness of the outer jacket portion of the elongated integral body of the cable.

In an alternative embodiment, the extrusion apparatus of the invention further comprises a channel centrally formed within the support body of the male die for housing a longitudinal reinforcing member.

According to a further aspect thereof, the present invention relates to a plant for continuously manufacturing a communications cable, comprising at least one extrusion apparatus as defined above.

Preferably, the plant further comprises:

at least one feeding device for supplying a plurality of insulated conductors;

at least one twisting device for twisting in pairs said plurality of insulated conductors at a predetermined lay length around each other.

Preferably, the plant further comprises at least one tensioning device downstream of said twisting device for imparting a predetermined tension to said plurality of twisted pairs.

Advantageously, the tensioning device allows to adjust the tension of the twisted pairs of insulated conductors.

Preferably, the plant further comprises a lubricating device upstream of said extrusion apparatus for delivering a predetermined amount of a suitable lubricating material onto the surface of said twisted pairs of insulated conductors.

In this way, it is advantageously possible to facilitate the sliding movement of the twisted pairs within the cavities of the elongated integral body along the longitudinal direction of the cable.

Preferably, the plant further comprises a vacuum-cooling apparatus arranged downstream of said extrusion apparatus for vacuum-cooling the cable leaving said extrusion apparatus.

Advantageously, this vacuum-cooling apparatus enables to stabilize the shape of the elongated integral body and, most importantly, of the cavities provided therein in an optimal manner and as promptly as possible after the extrusion of the cable.

Preferably, the plant further comprises at least one cable storing device downstream of said extrusion apparatus for storing the cable leaving said extrusion apparatus.

Additionally, the present invention provides a method for manufacturing a communications cable comprising the steps of:

a) providing at least two couples of insulated conductors;

b) reciprocally twisting in pairs said insulated conductors at a predetermined lay length, to form at least two twisted pairs of insulated conductors;

c) arranging the twisted pairs of insulated conductors according to a predetermined spatial configuration wherein each of said pairs is kept at a predetermined distance from the other pairs;

d) feeding said spatially arranged pairs of insulated conductors to an extrusion apparatus;

e) extruding a suitable polymeric material around the twisted pairs while maintaining said pairs in said predetermined spatial configuration, so as to form a cable comprising an elongated integral body provided with a plurality of cavities having a substantially circular cross-section longitudinally formed in said elongated integral body, each of said cavities slidingly housing a respective one of said pairs and having a maximum diameter adapted to prevent any relative movement of the twisted pairs of insulated conductors with respect to one another.

Advantageously, in the manufacturing method of the present invention the extrusion of the elongated integral body directly around the twisted pairs enables to manufacture in just one shot an elongated integral body around the twisted pairs, with an ensuing productivity increase with respect to the methods of the prior art.

Furthermore, the present invention provides a method for manufacturing a communications cable comprising the steps of:

a) providing at least two couples of insulated conductors, at least one optical transmitting element and/or at least one electrically conductive element;

b) reciprocally twisting in pairs said insulated conductors at a predetermined lay length, to form at least two twisted pairs of insulated conductors;

c) arranging said twisted pairs of insulated conductors, said optical transmitting element and/or said electrically conductive element according to a predetermined spatial configuration, wherein said twisted pairs, said optical transmitting element and/or said electrically conductive element are kept at a predetermined distance from the other pairs and from the other optical transmitting and/or electrically conductive elements;

d) feeding said spatially arranged pairs of insulated conductors, optical transmitting element and/or electrically conductive element to an extrusion apparatus;

e) extruding a suitable polymeric material around the twisted pairs, the optical transmitting element and/or the electrically conductive element while maintaining said pairs, said optical transmitting element and/or said electrically conductive element in said predetermined spatial configuration.

Advantageously, the method of the invention enables to manufacture in just one shot a cable having transmissive elements of different nature, such as at least two twisted pairs of insulated conductors, an optical transmitting element and/or an electrically conductive element, thus accomplishing both the transmission of data and the power supply to electrical devices.

Preferably, the twisting step of the insulated conductors is carried out so as to impart to each twisted pair different lay lengths comprised between about 10 mm and about 30 mm.

Preferably, the method further comprises the step of vacuum-cooling the cable leaving the extrusion apparatus, so as to promote a shape stabilization of the elongated integral body and of the cavities provided therein.

Advantageously, this vacuum-cooling step enables to stabilize the shape of the elongated integral body and substantially avoids the risk of a collapse of the cavities provided therein as promptly as possible after the extrusion of the cable.

Preferably, the method for manufacturing a communications cable further comprises the steps of:

providing a longitudinal reinforcing member;

arranging said longitudinal reinforcing member at a predetermined location within said spatial configuration of the twisted pairs of insulated conductors;

feeding said longitudinal reinforcing member to said extrusion apparatus, together with said spatially arranged pairs of insulated conductors.

In this way, a cable provided with an enhanced strength is advantageously obtained.

Preferably, said longitudinal reinforcing member is located at a central location within said spatial configuration of the twisted pairs of insulated conductors.

Preferably, the aforementioned method steps are carried out by means of the extrusion apparatus and plant described hereinabove.

BRIEF DESCRIPTION OF THE DRAWINGS

Additional features and advantages of the invention will become more readily apparent from the description of some preferred embodiments of a communications cable and of a method for manufacturing the same according to the invention, made with reference to the attached drawing figures in which, for illustrative and non limiting purposes, a communications cable, an extrusion apparatus and a plant comprising said extrusion apparatus for carrying out said method are shown.

In the drawings.

DETAILED DESCRIPTION OF SOME PREFERRED EMBODIMENTS

Figure 1:
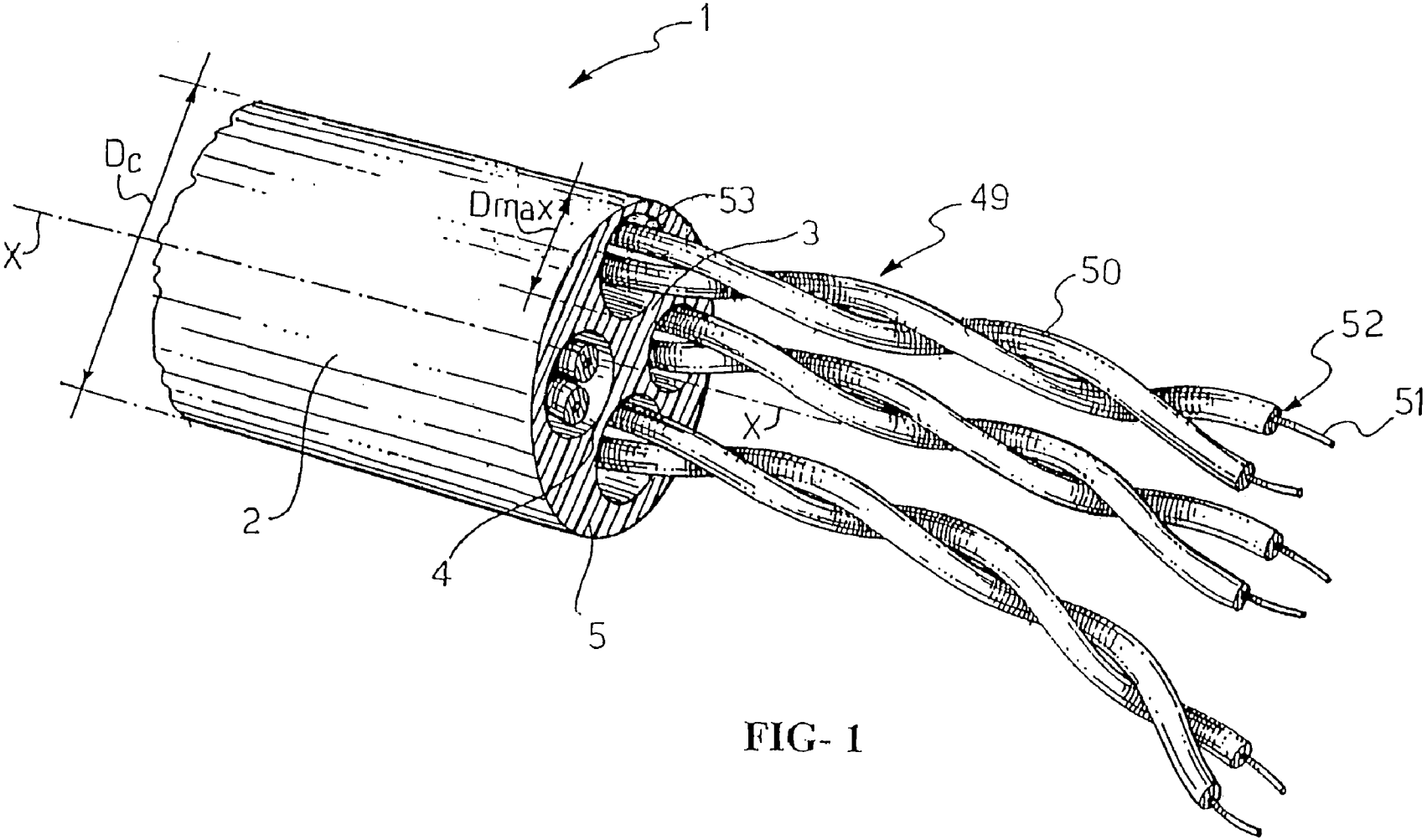
FIG. 1 is a perspective view of a first preferred embodiment of a communications cable according to the invention.

Referring to FIG. 1, a communications cable according to a first preferred embodiment of the invention is generally indicated at 1. The cable 1 has an outer diameter $D_c$ and comprises four twisted pairs 49 of insulated conductors 50.

Preferably, the outer diameter $D_c$ of the cable 1 is comprised between about 5.5 mm and about 7.5 mm, while outer diameter of the insulated conductors 50 is comprised between about 0.75 mm and about 1.5 mm.

Each insulated conductor 50 comprises a conductive core 51 surrounded by a polymeric insulation 52. The conductive core 51 may be a metallic wire made of any of the well-known metallic conductors, such as copper, aluminum, copper-clad aluminum, copper-clad steel, etc. For most applications, the thickness of the insulating material is preferably comprised between about 0.10 mm and about 0.25 mm. The insulating material may be foamed or expanded through the use of a blowing or foaming agent. Suitable insulating materials for the twisted pairs include polyvinylchloride (PVC), polyvinylchloride alloys, polyethylene (PE), polypropylene (PP) and flame retardant materials such as fluorinated polymers. Exemplary fluorinated polymers to be used in the invention include fluorinated ethylene propylene copolymers (FEP), ethylene trifluoroethylene copolymers (ETFE), ethylene chlorotrifluoroethylene copolymers (ECTFE), perfluoroalkoxypolymers (PFA's), and mixtures thereof. Exemplary PFA's include copolymers of tetrafluoroethylene and perfluoropropylvinylether (e.g. Teflon® PFA 340) and copolymers of tetrafluoroethylene and perfluoromethylvinylether (MFA copolymers which are available from Ausimont S.p.A.).

The insulated conductors 50 are twisted in pairs, preferably at different lay lengths of about 10 mm to about 30 mm. For instance, when four twisted pairs are provided within the four longitudinal cavities, as illustrated in FIG. 1, the respective lay length may be of about 12 mm, about 15 mm, about 18 mm and about 21 mm.

The twisted pairs 49 are slidingly housed in respective cavities 53 longitudinally formed within an elongated integral body 2 made of any of the polymer materials conventionally used in cable construction described hereinabove, such as for example polyethylene (PE).

The cavities 53 have a substantially circular cross-section having a diameter $D_{max}$ adapted to prevent any relative movement of the twisted pairs 49 with respect to one another and allowing, at the same time, each twisted pair 49 to be substantially free to move within the cavities 53 along the longitudinal direction X—X of the cable 1.

Each cavity is defined by a respective substantially continuous peripheral wall, which allows to physically separate said cavity from the others, thus avoiding undesirable contacts between twisted pairs housed in different respective cavities.

Figure 2:
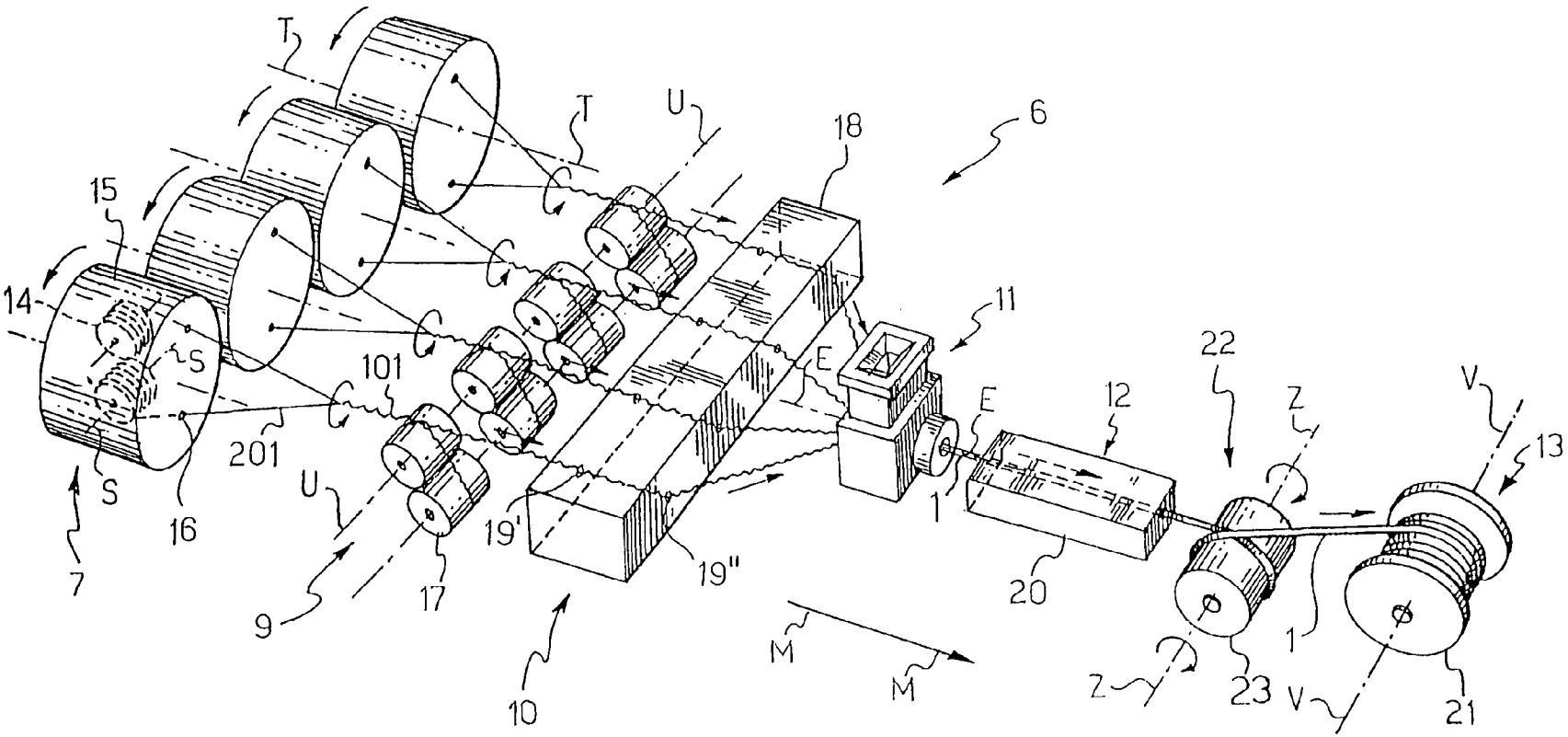
FIG. 2 is a perspective schematic view of a plant for manufacturing the communications cable of FIG. 1.

The cavities 53 are preferably angularly offset with respect to one another, in the example illustrated in FIG. 1 at an angle of about 90°. In the example illustrated, the diameter $D_{max}$ of each cavity 53 is of about 2.0 mm. Referring to a cross-section of the cable 1, three main portions forming the elongated integral body 2 may be identified. A central core portion 3, a plurality of spacer portions 4 radially extending from the central core portion 3 and an outer jacket portion 5 integral with the spacer portions 4. With reference to the schematic view of FIG. 2, a preferred embodiment of a plant 6 for continuously manufacturing the above-mentioned communications cable 1 will now be illustrated. The plant 6 comprises an extrusion apparatus 11 which will be described in greater detail in the following with reference to FIG. 3.

In the illustrated example, the plant 6, which is disposed along a manufacturing direction M—M substantially parallel to an extrusion axis E—E of the extrusion apparatus 11, further comprises a feeding device 7 adapted to supply the insulated conductors 50. In order to manufacture the above-mentioned communications cable 1, such feeding device 7 comprises eight feeding reels 14, each supplying one insulated conductor 50. The feeding reels 14 are disposed in pairs within respective twisting cylinders 15 each forming a twisting device of the insulated conductors 50. Each twisting cylinder 15 comprises two apertures 16 crossed by the insulated conductors 50 unwound from the feeding reels 14 housed in the cylinder 15. In this way, each twisting cylinder 15 is adapted to twist two insulated conductors 50 around each other.

Advantageously, such a feeding device 7, which incorporates the twisting devices 15, enables to reduce the space occupied by the plant 6. However, in an alternative embodiment, the twisting devices 15 may be arranged immediately downstream of the feeding device 7, in which case a greater space would be occupied by the plant 6.

Preferably, each feeding reel 14 rotates around a rotation axis S—S, and each twisting cylinder 15 rotates around a rotation axis T—T, said axis S—S and said axis T—T being, respectively, substantially perpendicular and substantially parallel to the manufacturing direction M—M.

Immediately downstream of the twisting device 8, a tensioning device 9, for example constituted by a plurality of co-rotating cylinders 17 arranged in pairs, is provided so as to impart a predetermined tension to the twisted pairs 49. The cylinders 17 rotate about a rotation axis U—U substantially perpendicular to the manufacturing direction M—M. In the embodiment illustrated in FIG. 2, there are four pairs of co-rotating cylinders 17 adapted to impart a predetermined tension to the four twisted pairs 49. The tensioning device 9 may have the additional function of temporarily storing, if necessary, a predetermined length of twisted pairs 49.

Optionally, the plant 6 comprises a lubricating device 10 supported downstream of the tensioning device 9 and upstream of the extrusion apparatus 11. The lubricating device 10 is adapted to deliver, for example by spraying, a predetermined amount of lubricating material onto the surface of the twisted pairs 49 of insulated conductors 50. Suitable lubricating materials include silicone compounds, hydrocarbon lubricating compounds, fluorinated liquids, talc, grease and the like.

The lubricating device 10 preferably comprises a chamber 18, in which a plurality of delivering nozzles, conventional per se and not shown, are supported. The chamber 18 is provided with a plurality of inlet apertures 19' and outlet apertures 19" for respectively letting in and letting out the twisted pairs 49 into and from the lubricating device 10. The nozzles are in fluid communication with respective reservoirs containing the lubricating material, conventional per se and not shown, by means of a number of conventional conduits not shown.

In the illustrated embodiment, the plant 6 further comprises, downstream of the extrusion apparatus 11, a vacuum-cooling apparatus 12 for vacuum-cooling the cable 1 leaving the extrusion apparatus 11. The vacuum-cooling apparatus 12 comprises a chamber 20 in which a suitable cooling medium, such as for example cooled water, circulates and which is in fluid communication with a vacuum-pump, not shown, so as to obtain a vacuum degree, preferably comprised between about 40 mmHg and about 250 mmHg, adapted to minimize the risk of any collapse of the cavities 53 formed in the elongated integral body 2 of the cable 1.

Preferably, the chamber 20 is also in fluid communication with a heat exchanger, not illustrated and known per se, which is provided for cooling the cooling medium leaving the chamber 20. Preferably, the chamber 20 and the heat exchanger are arranged in a closed circuit in which a circulation pump (not shown) is provided for recirculating the cooling medium, thus limiting the consumption of the same.

Preferably, the plant 6 further comprises, downstream of the vacuum-cooling apparatus 12, at least one cable storing device 13 for storing the cable 1 leaving the vacuum-cooling apparatus 12. The cable storing device preferably comprises a storing reel 21 having a rotation axis V—V substantially perpendicular to the manufacturing direction M—M.

In the illustrated embodiment, between the vacuum-cooling apparatus 12 and the cable storing device 13 a cable tensioning device 22 is also provided, preferably comprising a tensioning cylinder 23 having a rotation axis Z—Z substantially perpendicular to the manufacturing direction M—M.

Figure 3:
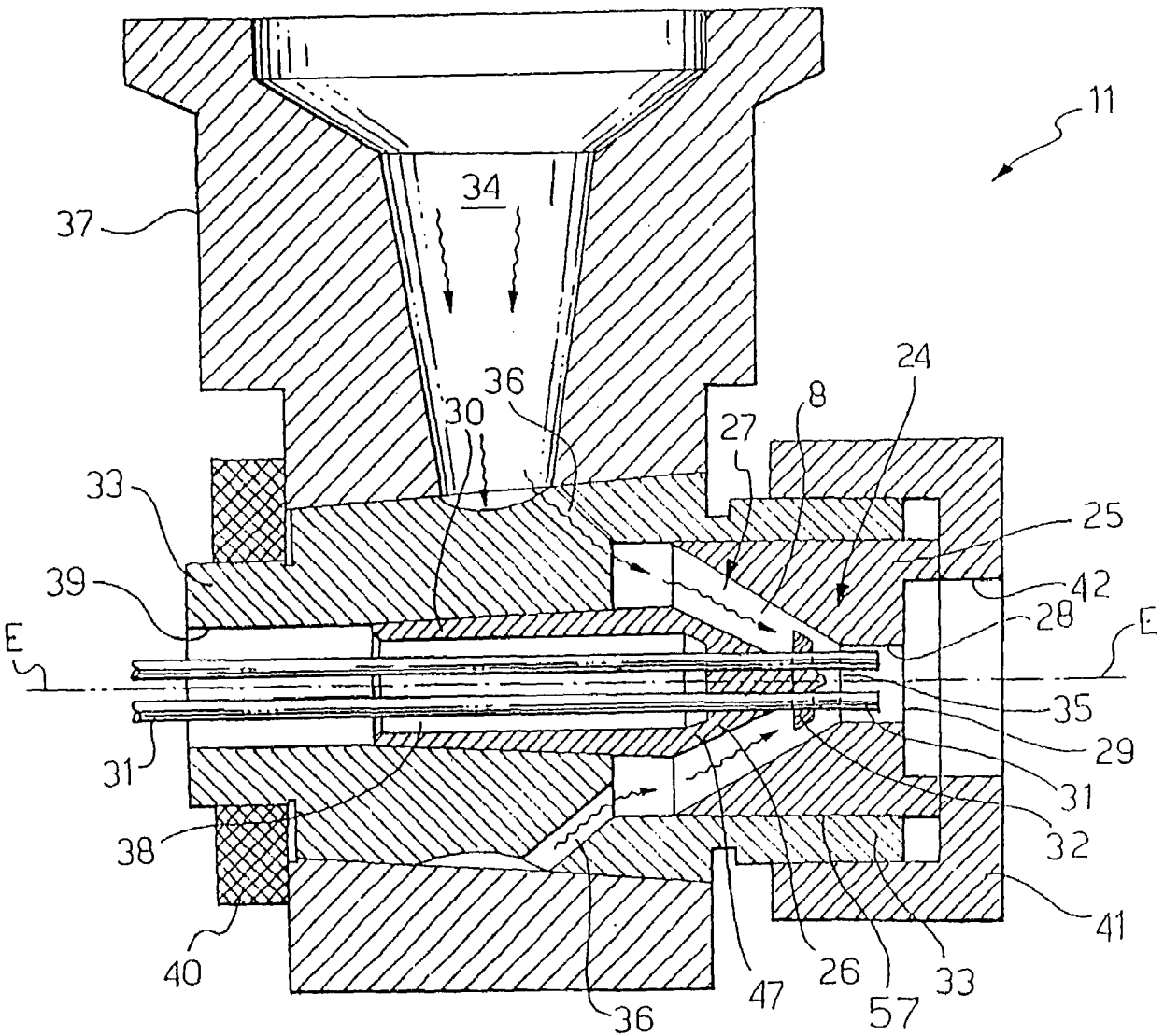
FIG. 3 is a cross-sectional view of an extrusion apparatus used for manufacturing the cable of FIG. 1.
Figure 5:
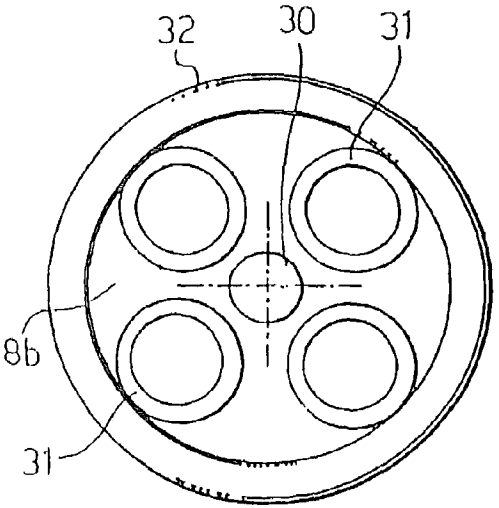
FIG. 5 is a front view of the male die of the extrusion apparatus of FIG. 3.

Referring now to FIG. 3, the above-mentioned extrusion apparatus 11 making part of the plant 6 will be now described in detail. According to the invention, the extrusion apparatus 11 comprises an extrusion die 24 supported by a support frame 33 and arranged along the extrusion axis E—E.

The extrusion die 24 includes a female die 25 and a male die 26.

The male die 26 is partially housed within an opening 39 longitudinally formed in the support body 33 and protrudes along the extrusion axis E—E within an extrusion chamber 47 defined between the support body 33 and the female die 25.

The female die 25 has a first substantially funnel-shaped portion 27 and a second cylindrical portion 28 having a substantially constant diameter and provided with respective inner and outer opening 35, 29. Preferably, the inner walls of the first portion 27 form an angle $\alpha$ with respect to the extrusion axis E—E. In the example illustrated, such angle $\alpha$ is of about 25°.

The second portion 28 of the female die has a diameter D which is substantially equal to the outer diameter $D_c$ of the cable 1 to be manufactured.

The male die 26 comprises a support body 30 which advantageously includes an inner cavity 38 that allows to reduce the weight thereof.

The support body 30 supports a plurality of ducts 31 extending along a direction substantially parallel to the extrusion axis E—E and having a diameter $D_d$ which is substantially equal to the diameter $D_{max}$ of the cavities of the cable 1 to be manufactured. The plurality of ducts 31 is arranged according to a predetermined spatial configuration corresponding to the arrangement of the cavities 53 in the final communications cable 1. In the example illustrated, four ducts 31 are arranged according to a square array. According to the invention, and as illustrated in the enlarged view of FIG. 4, the male die 26 further comprises a ring-shaped splitting member 32 which is supported by the ducts 31 at a predetermined distance $L_2$ from the first portion 27 of the female die 25.

The female die 25 and the male die 26 define between each other an extrusion flowpath, generally indicated at 8, for the polymeric material being extruded to form the elongated integral body 2 of the communications cable 1.

More specifically, a radially inner portion **8*a* of the extrusion flowpath 8 is defined within the male die 26 between the ring-shaped member 32 and the support body 30, and a radially outer portion 8*b* of the extrusion flowpath 8 is defined between the male die 26 and the female die 25. In this way, the ring-shaped splitting member 32 splits the overall flow of material being extruded (polyethylene) into a radially inner subflow and a radially outer subflow which will form the radially inner portions (i.e. the central core portion 3 and the spacer portions 4) and, respectively, the radially outer portions (i.e. the outer jacket portion 5) of the elongated integral body 2 of the communications cable 1**.

Between the front side of the ring-shaped splitting member 32 and the inner opening 35 of the second portion 28 of the female die 25 a distance $L_1$ is provided. The distance $L_1$ is suitably selected in order to obtain the desired thickness of all the portions (core 3, spacers 4 and outer jacket 5) of the cable 1. In the illustrated example, the distance $L_1$ is of about 1 mm. Preferably, the radially outer surface of the ring-shaped splitting member 32 is tapered.

The radially outer surface of the splitting member 32 preferably forms a taper angle β with respect to the extrusion axis E—E, which is preferably equal to the angle α.

In the example illustrated α and β have a value of about 25°.

In the shown example, the above distance $L_2$, determined between the radially outer surface of the ring-shaped splitting member 32 and the inner walls of the first portion 27 of the female die 25, is of about 1 mm.

The ring-shaped splitting member 32 is preferably positioned along the male die 26 in such a way as to determine a suitable distance $L_3$ between its front side and the free ends of the ducts 31. In the illustrated example, the distance $L_3$ is of about 8 mm.

Figure 4:
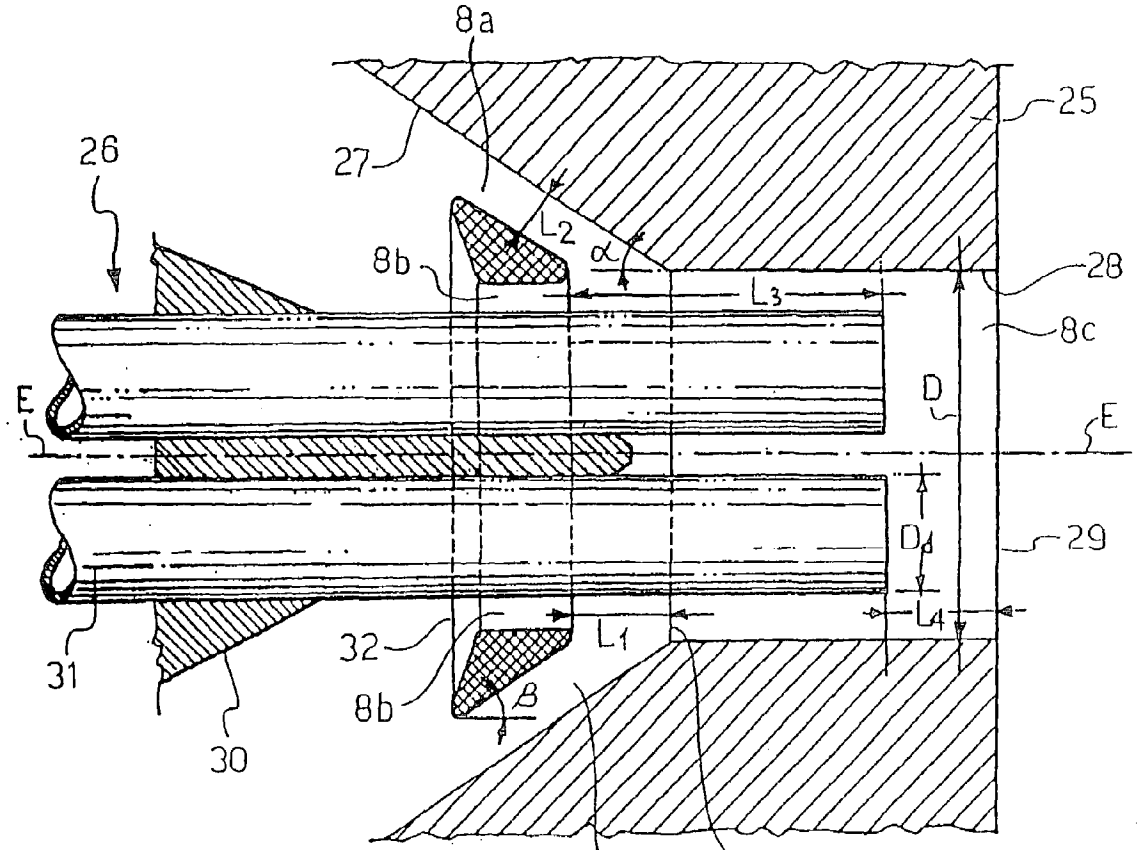
FIG. 4 is an enlarged cross-sectional view of some details of the extrusion apparatus of FIG. 3.

As shown in FIGS. 3 and 4, the free ends of the ducts 31 are preferably housed in the second portion 28 of the female die 25 at a predetermined distance $L_4$ from the outer opening 29 of the second portion 28.

In this way, upstream of the outer opening 29 of the extrusion apparatus 11 and within the second portion 28 of the female die 25, an end portion 8*c* of the extrusion flowpath 8 is defined which contributes to stabilize both the shape of the elongated integral body 2 and the shape of the cavities 53.

In the embodiment illustrated, such a distance $L_4$ has a value of about 2 mm.

Advantageously, furthermore, the position of the free ends of the ducts 31 in the second portion 28 of the female die 25 (i.e. the distance $L_4$) may be regulated so as to form spacer portions 4 integral with the outer jacket portion 5, to obtain the desired thickness of the same and to allow the formation of cavities 53 having the desired diameter $D_{max}$. Preferably, once a suitable value of the distance $L_3$ has been determined, this adjustment of the free ends of the ducts 31 in the second portion 28 of the female die 25 so as to determine a proper distance $L_4$ is carried out by displacing the female die 25 with respect to the male die 26.

In the preferred embodiment shown in FIG. 3, the position of the female die 25 with respect to the male die 26 may be conveniently regulated as follows.

In this preferred construction, the female die 25 is slidingly mounted within a mating cavity 57 formed at a front end of the support frame 33 and, as such, it may be freely moved along the latter thanks to the action of a threaded locking ring 41 threadably engaged in a way known per se with the outer surface of the support frame 33 and abutting against the female die 25.

The relative position of the female die 25 with respect to the male die 26 can thus be easily adjusted by moving the locking ring 41 along the support frame 33, i.e. by screwing or unscrewing the same.

Advantageously, the contact between the female die 25 and an inner annular surface of the locking ring 41 is effectively maintained during the extrusion operations thanks to the pressure exerted by the material being extruded on the first portion 27 of the female die 25.

Conveniently, the locking ring 41 is centrally provided with an opening 42, coaxial with the outer opening 29 of the second portion 28 of the female die 25, for delivering the extruded cable 1 out of the extrusion apparatus 11.

It will be understood by those skilled in the art that in order to regulate the position of the free ends of the ducts 31 in the second portion 28 of the female die 25, other measures may be envisaged such as, for example, by providing a treaded connection of the female die 25 within the cavity 57 or by providing other fixing means for maintaining at a fixed position the locking ring 41.

In a way known per se, for example by means of ducts 36 illustrated in FIG. 3, the extrusion chamber 47 defined within the cavity 57 is in communication with a conveying chamber 34 defined within a feeding hopper 37 fixed to the support frame 33 downstream of a conventional extrusion screw, not illustrated and known per se. In this embodiment, the extrusion screw is disposed along a direction substantially perpendicular to the extrusion axis E—E.

The extrusion apparatus 11 is also provided with a threaded locking ring 40, adapted to close the rear end of the same.

With reference to the plant 6 described hereinabove, a first embodiment of a method according to the invention for manufacturing the communications cable 1 comprises'the following steps.

In a first step, a plurality of insulated conductors 50 is provided by unwinding the feeding reels 14 of the feeding device 7. The insulated conductors 50 are supplied through the outlet apertures 16 of the twisting cylinders 15. As a consequence of the rotation of the twisting cylinders 15 about the rotation axis T—T, the insulated conductors 50 are reciprocally twisted in pairs, at a selected lay length. In this way, a plurality of twisted pairs 49 of insulated conductors 50 is formed.

In a further step, and immediately downstream of the twisting device 8, a predetermined tension is imparted to the twisted pairs 49 by means of the tensioning device 9, around which the twisted pairs 49 are wound by rotating the cylinders 17 about the rotation axis U—U.

In a preferred embodiment, the method of the invention comprises the additional step of delivering a lubricating material onto the surface of the twisted pairs 49. According to this embodiment, the twisted pairs 49 are transferred to the lubricating device 10 through the inlet apertures 19'. In the chamber 18 of the lubricating device 10, the surface of the twisted pairs 49 is coated with lubricating material sprayed by the delivering nozzles. At the end of this step, the twisted pairs 49 leave the lubricating device 9 through the outlet apertures 19" and are transferred to the extrusion apparatus 11.

At this point, according to a further step of the method of the invention, the twisted pairs 49 of insulated conductors 50 enter the ducts 31. In this way, each of the twisted pairs 49 is kept at a predetermined distance from the other pairs 49 according to a predetermined spatial arrangement.

At the same time a constant flow of polymeric material is fed by the extrusion screw to the extrusion apparatus 11 wherein the material is extruded around the twisted pairs 49 while maintaining the same in said predetermined spatial configuration by means of the ducts 31. More particularly, the flow of the polymeric material being extruded is split into two subflows flowing in the radially inner and radially outer portions 8*a*, 8*b* of the extrusion flow path 8. In this way, the elongated integral body 2 of the cable 1 is continuously formed by extrusion preventing at the same time that the twisted pairs 49 of insulated conductors 50 become permanently linked to the inner surface of the cavities 53.

At the end of the extrusion step, the cable 1, which has a temperature preferably comprised between about 150° C. and about 220° C. and, still more preferably, between about 150° C. and about 180° C., is vacuum-cooled by means of the vacuum-cooling apparatus 12 to a temperature comprised between about 20° C. and about 50° C., at a pressure of about 80 mmHg, so as to promote an effective shape stabilization of the cavities 53.

Finally, immediately downstream of the vacuum-cooling apparatus 12, the cable 1 is wound around the cable tensioning device 22. Once the desired tension has been imparted to the cable 1, the latter is transferred to the cable storing device 13 and wound therearound.

Additional embodiments of the communications cable, of the extrusion apparatus and of the manufacturing method according to the invention will now be described with reference of FIGS. 6–10.

In the following description and in said figures, the elements of the communications cable 1 and of the extrusion apparatus 11 structurally or functionally equivalent to those previously illustrated with reference to FIGS. 1–5 will be indicated by the same reference numbers and will not be further described.

Figure 6:
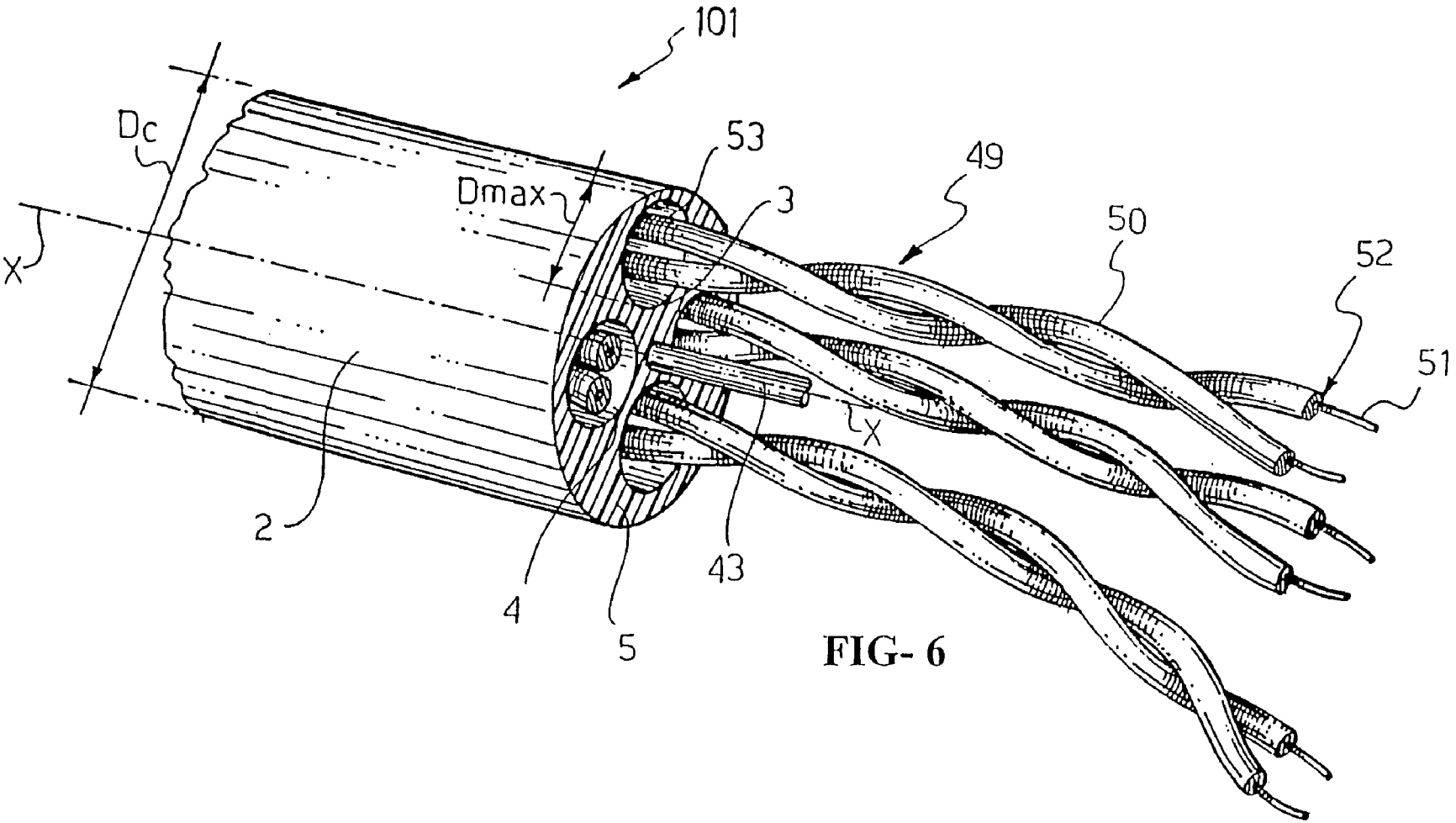
FIG. 6 is a perspective view of an alternative embodiment of a communications cable according to the invention.

According to an additional embodiment of the communications cable of the invention, indicated at 101 in FIG. 6, a longitudinal reinforcing member 43, for example a wire made of steel or of fiber-reinforced plastics (for example plastics incorporating fiberglass), is centrally disposed within the elongated integral body 2.

Figure 8:
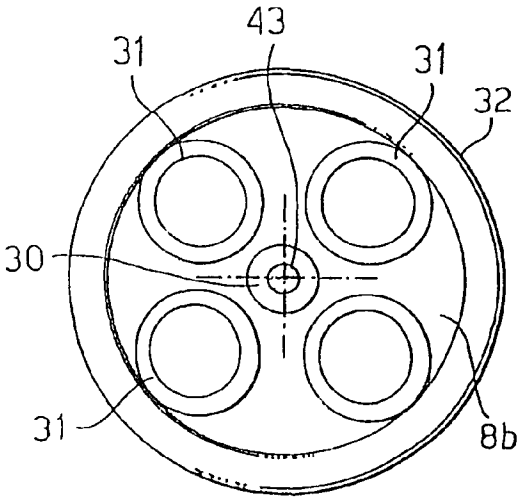
FIG. 8 is a front view of the male die of the extrusion apparatus of FIG. 7.
Figure 7:
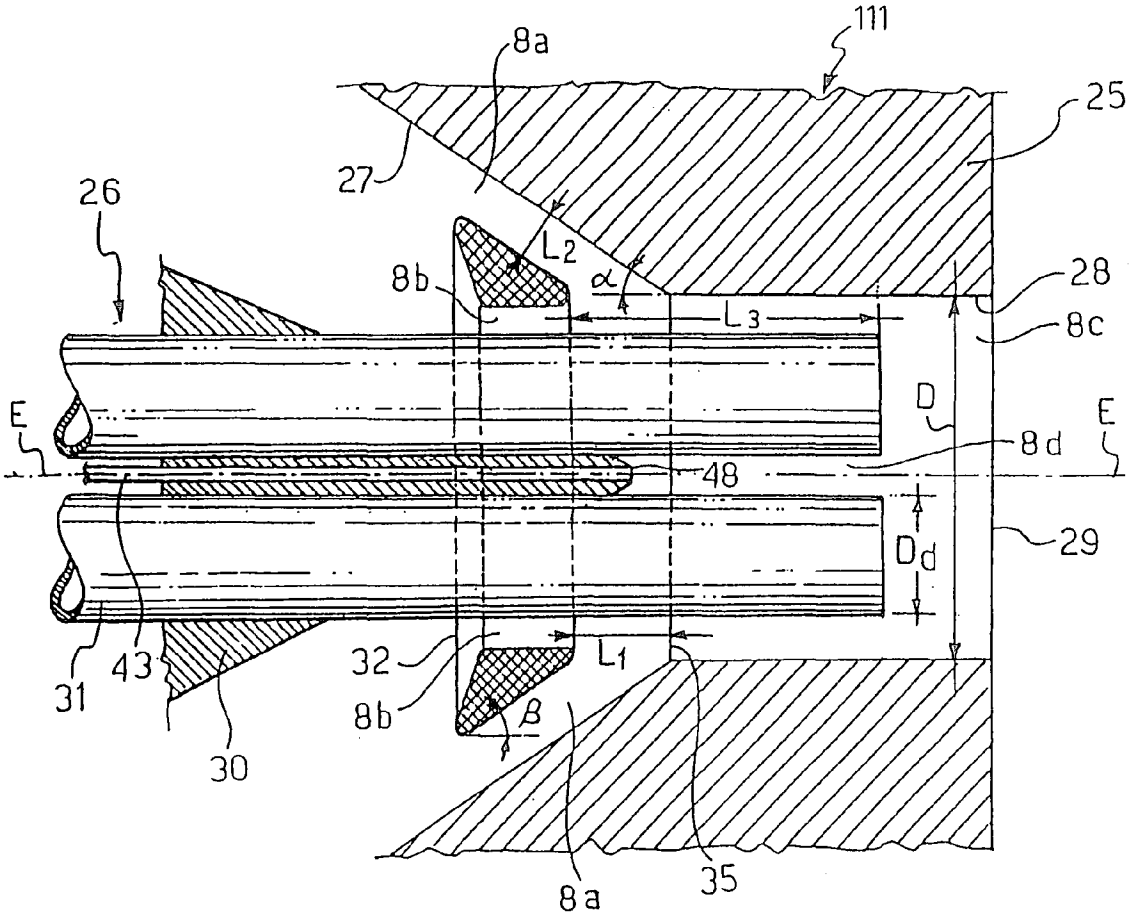
FIG. 7 is an enlarged cross-sectional view of some details of an alternative embodiment of an extrusion apparatus used for manufacturing the communications cable of FIG. 6.

In order to obtain a cable 101 reinforced in this manner, an additional embodiment of the extrusion apparatus of the invention, indicated at 111 in FIGS. 7 and 8, comprises a male die 26 provided with a support body 30 in which a channel 48 of suitable shape is axially formed. Preferably, the channel 48 is centrally disposed along the extrusion axis E—E and is adapted to house the longitudinal reinforcing member 43 up to a tip portion of the support body 30.

Accordingly, an additional embodiment of the method of the invention for manufacturing the above-mentioned cable 101 further comprises the following additional steps.

In a first step, the longitudinal reinforcing member 43 is provided in a manner known per se. Subsequently, the longitudinal reinforcing member 43 is arranged at a central location within the spatial configuration of the twisted pairs 49 of insulated conductors 50 and, finally, the longitudinal reinforcing member 43 is fed to said extrusion apparatus 111 (more particularly, it enters the channel 48 centrally disposed along the extrusion axis E—E), together with the spatially arranged pairs 49 of insulated conductors 50.

During the extrusion step of the method, the reinforcing member 43 travels along the channel 48 up to the tip portion of the support body 30 before being incorporated in the polymeric material flowing in a central portion 8*d* of the flowpath 8 defined between the ducts 31.

In this way, a cable 101 provided with a predetermined enhanced strength, depending upon the material and upon the diameter of the reinforcing member 43, may be advantageously obtained.

Figure 9:
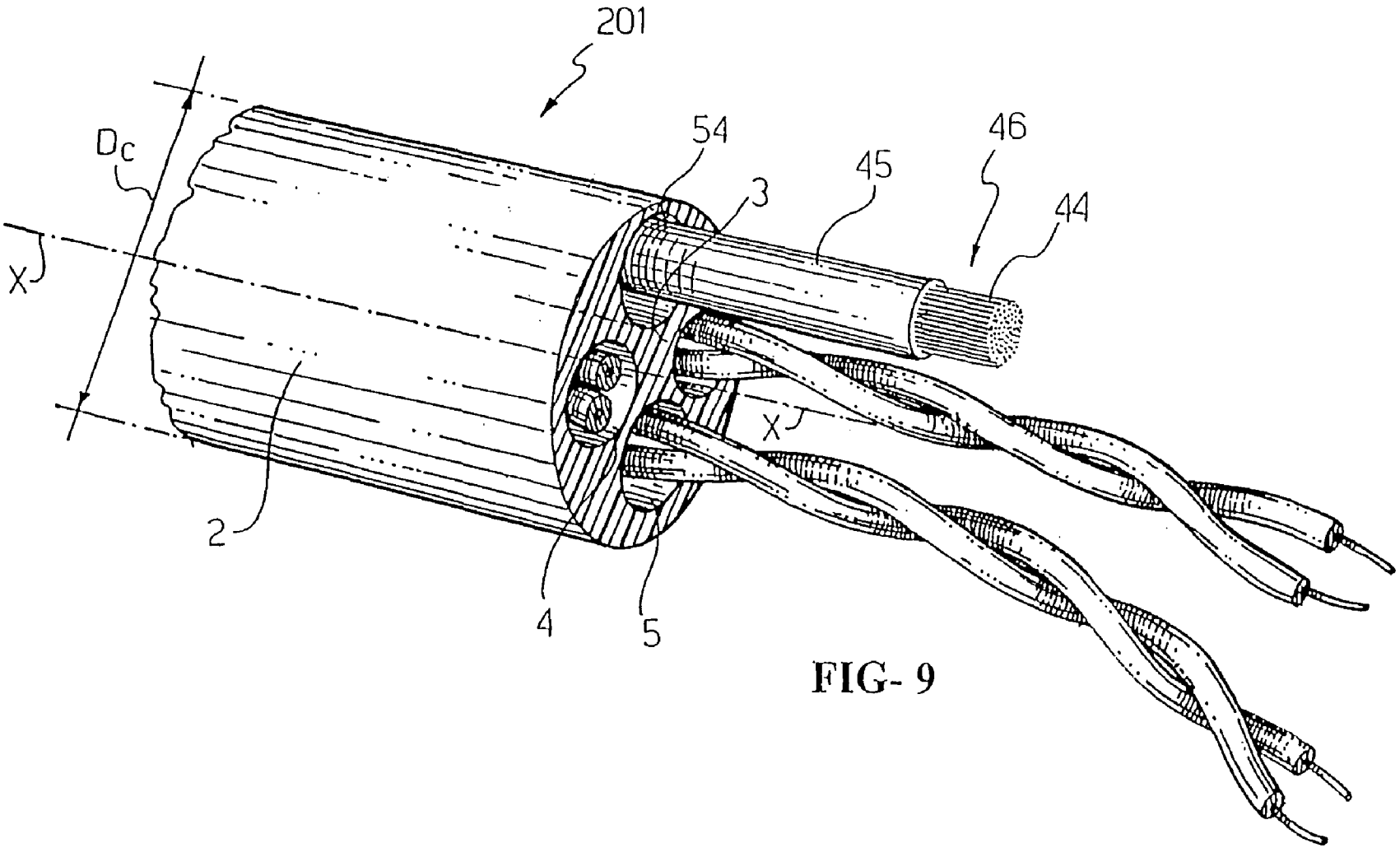
FIG. 9 is a perspective view of an alternative embodiment of a communications cable according to the invention.

FIG. 9 illustrates an alternative embodiment of the communications cable according to the invention, generally indicated at 201.

According to this alternative embodiment, the cable 201 comprises an optical transmitting element 46 housed in one cavity 54 formed in the elongated integral body 2. Although in the illustrated embodiment the cavity 54 has a substantially circular cross-section, such cavity 54 may have any suitable shape sufficient to contain the optical transmitting element 46.

For instance, as shown in FIG. 9, the optical transmitting element 46 may be in the form of a plurality of optical fibers 44 (e.g. twelve) enclosed in a microsheath 45 of polymeric material. This cable 201 advantageously allows to reach a plurality of end-users connected at different levels (i.e. connected by means of conventional copper wires or optical fibers) or to subsequently upgrade a conventional copper wire connection to an optical fiber connection.

According to an alternative embodiment, a cable according to the invention may also comprise, further to the at least two cavities respectively housing two twisted pairs, also at least one empty cavity adapted to receive an optical transmitting medium. Said cable may thus installed as such and an optical transmitting medium can subsequently be disposed within said empty cavity at the need, preferably by means of the so called "blown installation" technique. Depending on the dimensions of the empty cavity, either a single optical fiber or an assembly comprising a plurality of optical fibers, both specifically adapted for blown installation, may be installed in said cavity according to conventional blown installation techniques.

Figure 10:
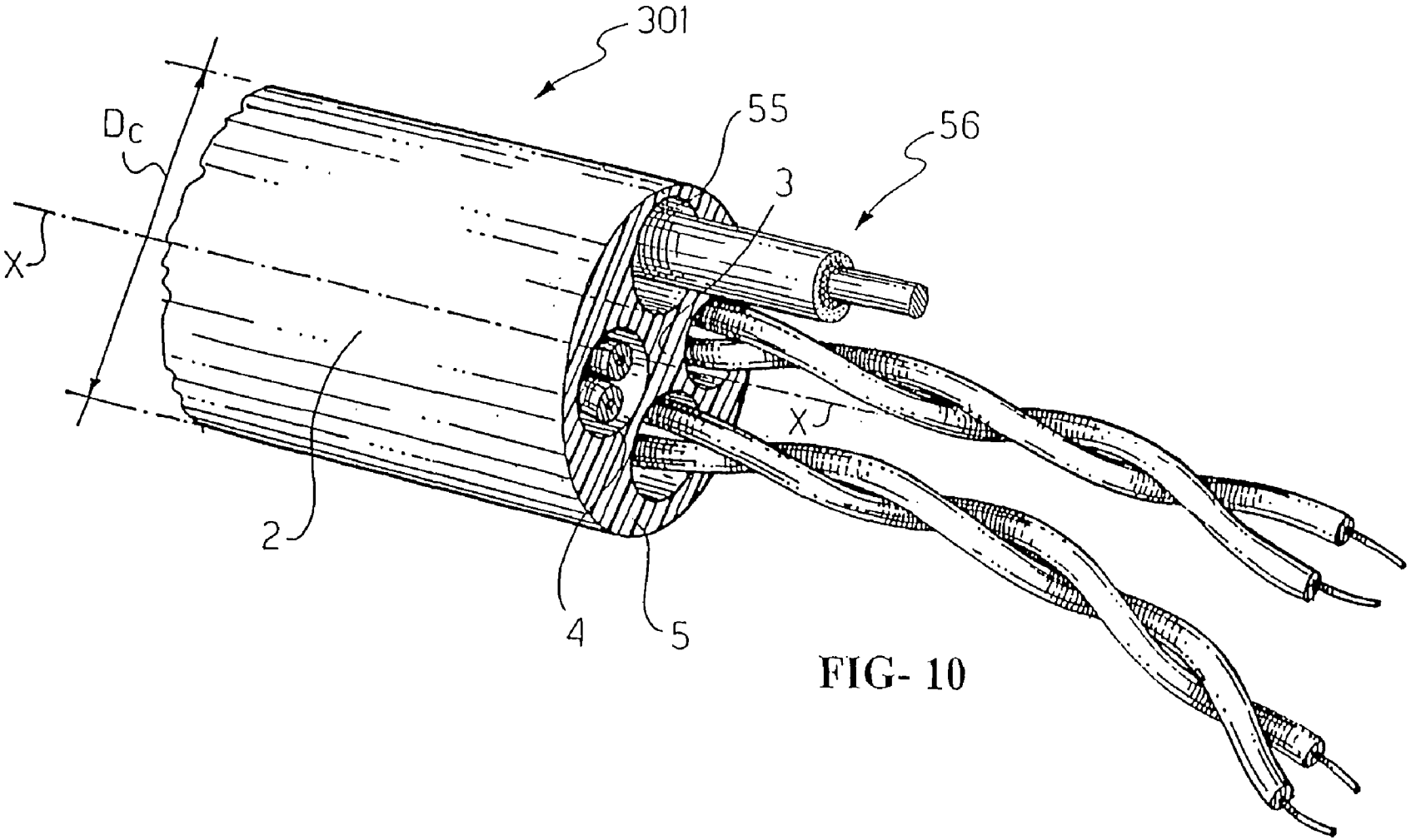
FIG. 10 is a perspective view of an additional embodiment of a communications cable according to the invention.

FIG. 10 illustrates another alternative embodiment of the communications cable according to the invention, generally indicated at 301.

According to such an embodiment, alternatively or in addition to the above-mentioned optical transmitting element, an electrically conductive element, e.g. an insulated copper wire, generally indicated at 56 in FIG. 10, is housed in a longitudinal cavity 55, according to the illustrated embodiment of substantially circular cross-section. The electrically conductive element 56 may replace one of the twisted pairs 49 in order to supply power to electrical devices, as in the case of opto-electric converters.

It will be understood by those skilled in the art that whenever a communications cable 201, 301 as described above (i.e. further comprising an optical transmitting element or an electrically conductive element, or both) is manufactured, the above-described plant 6 and method for continuously manufacturing the cable may be easily adapted to insert said optical transmitting element 46 or electrically conductive element 56 into the respective longitudinal cavity 54, 55. For example, with reference to FIG. 2, it is sufficient to replace a twisting cylinder 15 and a couple of feeding reels 14 with a single feeding reel for supplying a plurality of optical fibers enclosed in a microsheath of polymeric material in order to obtain a cable such as that shown in FIG. 9.

The invention claimed is:

1. A communications cable comprising:

at least two twisted pairs of insulated conductors housed in respective independent cavities longitudinally formed within an elongated integral body, said cavities being defined by a continuous peripheral wall, having a substantially circular cross-section, having a maximum diameter adapted to prevent any relative movement of the twisted pairs of insulated conductors with respect to one another, and each of the cavities extending in a uniform direction, which is parallel to a longitudinal axis of the cable, wherein said pairs of insulated conductors are slidingly housed in said cavities in such a way that each of said pairs of insulated conductors is substantially free to move within said cavities along the longitudinal direction of the cable.

2. The cable according to claim 1, wherein said insulated conductors are twisted at different lay lengths between 10 mm and 30 mm.

3. The cable according to claim 1, wherein said cavities have a maximum diameter between 1.5 mm and 3.0 mm.

4. The cable according to claim 1, wherein said elongated integral body comprises at least two cavities angularly offset with respect to one another at a predetermined angle.

5. The cable according to claim 1, further comprising an optical transmitting element or an electrically conductive element housed in a respective cavity longitudinally formed within said elongated integral body.

6. The cable according to claim 1, further comprising at least one additional independent empty cavity longitudinally formed within said elongated integral body.

7. The cable according to claim 1, further comprising a longitudinal reinforcing member centrally disposed within said elongated integral body.

* * * * *